US010011987B1

(12) United States Patent
Lehane et al.

(10) Patent No.: US 10,011,987 B1
(45) Date of Patent: Jul. 3, 2018

(54) MAIN TEE SPLICE PLATE

(71) Applicant: USG Interiors, LLC, Chicago, IL (US)

(72) Inventors: James J. Lehane, McHenry, IL (US); Abraham M. Underkofler, Salem, WI (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 15/482,973

(22) Filed: Apr. 10, 2017

(51) Int. Cl.

| | |
|---|---|
| ***E04C 3/00*** | (2006.01) |
| ***E04B 9/10*** | (2006.01) |
| ***E04B 1/41*** | (2006.01) |
| ***E04B 9/06*** | (2006.01) |

(52) U.S. Cl.
CPC ..... *E04B 9/10* (2013.01); *E04B 1/40* (2013.01); *E04B 9/067* (2013.01)

(58) Field of Classification Search
CPC ..... E04B 9/10; E04B 9/067; E04B 1/40
USPC ..... 52/848
See application file for complete search history.

(56) References Cited

U.S. PATENT DOCUMENTS

| | | | | |
|---|---|---|---|---|
| 4,317,318 | A * | 3/1982 | Sauer | E04B 9/122 52/506.06 |
| 4,335,973 | A * | 6/1982 | Beck | E04L 39/10 403/205 |
| 6,138,425 | A * | 10/2000 | Wendt | E04B 9/00 403/205 |
| 6,729,100 | B2 | 5/2004 | Koski et al. | |
| 7,788,872 | B2 * | 9/2010 | Platt | E04B 9/08 52/506.07 |
| 9,255,403 | B1 | 2/2016 | Lehane et al. | |
| 2010/0086348 | A1 * | 4/2010 | Funahashi | H02G 3/0456 403/306 |

* cited by examiner

*Primary Examiner* — Patrick J Maestri
(74) *Attorney, Agent, or Firm* — Pearne & Gordon LLP

(57) ABSTRACT

A metal splice plate for joining the ends of suspended ceiling main tees of different heights and load carrying capacity, the plate having a bottom edge lying along a straight line and having a tall section adjacent one end and a short section adjacent an end opposite said one end, a formation at each of said ends providing indicia for locating the formation on the respective section on an end of a main tee of a corresponding height longitudinally at a desired position relative to and spaced from a cross runner slot on the main tee of corresponding height.

7 Claims, 3 Drawing Sheets

MAIN TEE SPLICE PLATE

BACKGROUND OF THE INVENTION

The invention relates to suspended ceilings and, in particular, to improvements in grid construction.

PRIOR ART

Conventional grid systems for suspended ceilings support main tees from overhead structure and cross tees from the main tees. The main tees are rated by their beam strength which determines a maximum span between supports, typically suspension wires, for a given service duty.

Conditions may exist in a particular building where it is not practical to drop a wire, cable or like support from overhead structure. For example, air ducts for heating and air conditioning in the plenum above the ceiling often obstruct convenient placement of suspension wires in the area below the ducts. An obstructed overhead area may be adjacent or between other areas where direct overhead support is available. It is desirable that the exposed ceiling grid elements in such areas be integrated and be of uniform appearance.

SUMMARY OF THE INVENTION

The invention facilitates the construction of a suspension ceiling grid with main tees of different free span capacity while affording a uniform appearance below the entire grid. The invention provides a splice plate with a stepped profile that closely fits between the flange and bulb of butt jointed grid tees of conventional height and grid tees of extended height. When installed against the vertical webs of the main tees, the splice plate maintains both vertical and horizontal alignment between the joined tees. The disclosed splice plate has a length corresponding to the center-to-center distance of the cross tee slots in the tees being joined. The ends of the splice plate provide indicia for precisely registering the tees being joined end-to-end so that spacing of the cross tee slots across the joint is correct. The disclosed splice plate, additionally, can be field modified for use with somewhat shorter lighter duty main grid tees. The splice plate can be provided with a central clearance area that avoids interference with a bulbous part of an end connector on the end of a tee being joined by the splice plate.

DESCRIPTION OF THE PREFERRED EMBODIMENT

Figure 1:
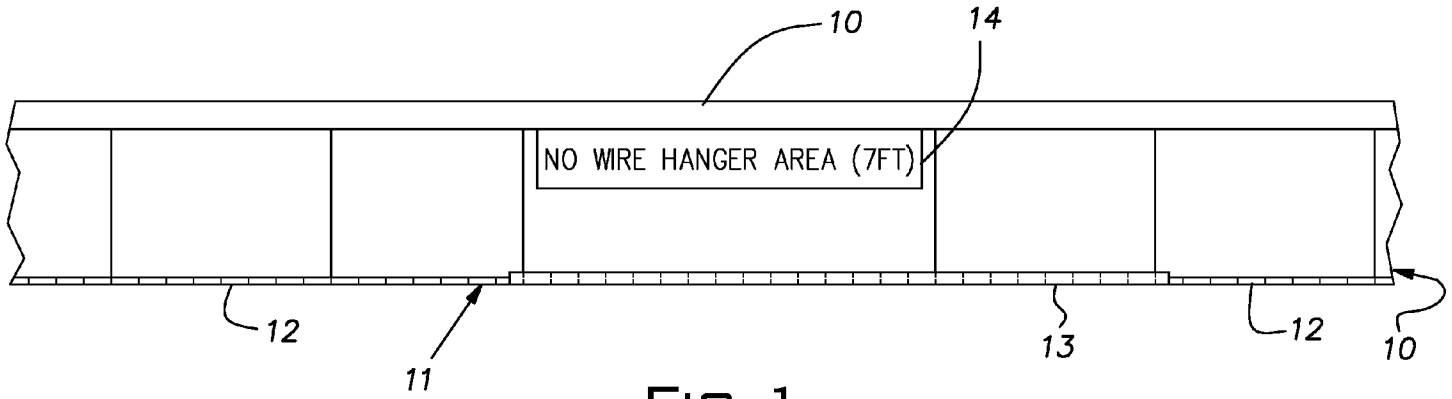
FIG. 1 is a schematic elevational view of a line of end joined main tees suspended from an overhead deck or other structure.
Figure 8:
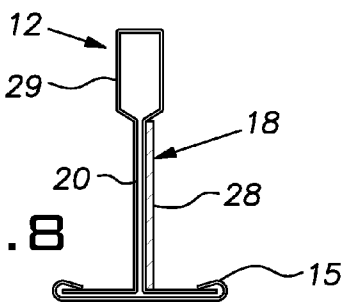
FIG. 8 is a cross-sectional view of a short main tee and splice plate taken in the plane 8-8 in FIG. 2.
Figure 7:
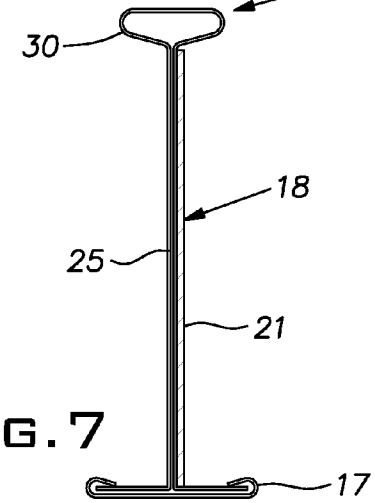
FIG. 7 is a cross-sectional view of a tall main tee and splice plate taken in the plane 7-7 in FIG. 2.

FIG. 1 is a schematic vertical cross-sectional view of an overhead support structure 10 of a building and a line 11 of main tees 12, 13. The support structure represents a deck of a roof or floor capable of supporting a suspended ceiling of generally conventional construction. The line 11 of main tees 12, 13 with like uniformly spaced parallel main tee lines and perpendicular cross tees establish the plane of a ceiling. A space above the ceiling, often called the plenum, typically contains utility ducts, plumbing and the like. Air handling ducts, for example, may extend over a relatively large part of the plenum and can prevent direct attachment of vertical suspension wires, cables, rods or the like between the overhead support 10 and the grid.

In the illustration of FIG. 1, vertical access to the support structure 10 is obstructed by a box area 14 representing a large utility duct or set of ducts, for example where, as the legend indicates, no hanger wires exist. This circumstance is problematic because, typically, main tees of common commercial grid require spans between supports to not exceed 4 foot, for example.

The invention solves the problem of limited overhead access by utilizing main tees 13 rated for spans greater than the standard of 4 foot, for example, in areas without available overhead support. The extended span grid tees 13 are joined to conventional main tees 12 in areas where overhead support is available. Examples of commercially available extended span grid tees are DXAS and DXTAS marketed by USG Donn® rated at 8 foot-0 inch unsupported span for intermediate duty (12 lb/LF) and 7 foot-0 inch unsupported span for heavy duty (16 lb/LF). These products have an overall height of 2¾ inch. Standard DX or DXT main tees marketed, for example, by USG Donn® rated for a 4 foot unsupported span (i.e. hanger spacing) have nominal heights of 1½ inch or 1⅝ inch.

All of the tees 12, 13 discussed here are characterized by a lower flange 15, 17, a vertical web 20, 25, and an upper hollow reinforcing bulb 29, 30 respectively all symmetrical about a vertical center plane. The lower flanges of the extended span main tees 13 and limited span main tees 12 are available with the same nominal face width of 9/16 inch or 15/16 inch for example. All of the main tees 12, 13 are provided with cross tee slots 16 having the same center-to-center distance and the same elevation above a respective lower flange face.

Figure 5:
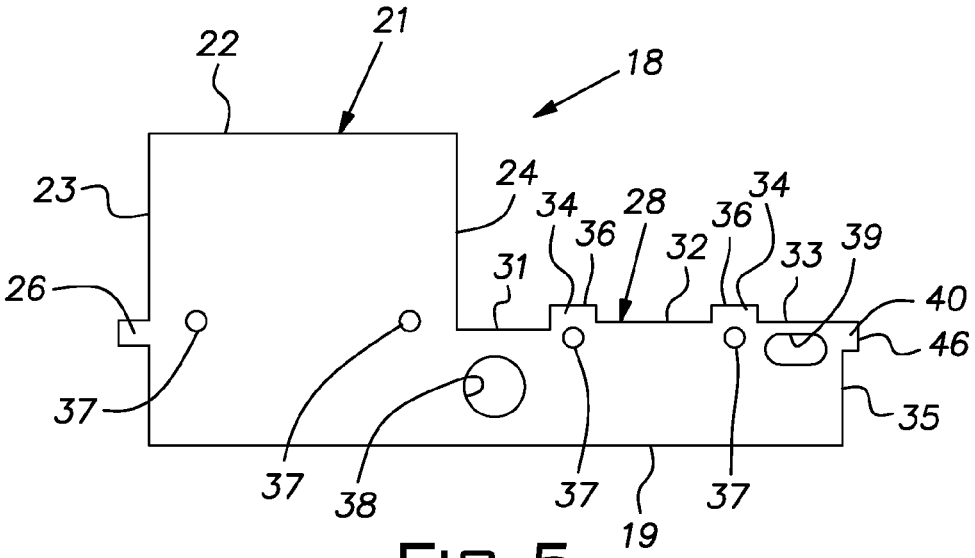
FIG. 5 is a profile view of the splice plate of the invention.

The invention provides a splice plate 18, FIG. 5, for accurately aligning and joining the ends of limited and extended span main tees 12, 13 so that their lower flange faces are aligned vertically and horizontally. The illustrated splice plate 18 is stamped from sheet metal in a plate configuration. For example, 0.048/0.052 H.D.G. (hot dipped galvanized) G60/G40 steel can be used to make the plate 18. The periphery of the splice plate 18 can be described as a rectangular polygon with its various sides or edges being generally straight and either horizontal or vertical. A bottom horizontal edge extends along a large majority of the length of the plate 18. A tall side of the plate (at the left in FIG. 5) has a horizontal upper edge 22 that extends across a majority of half the length of the plate. Outside and inside vertical edges 23, 24 delineate the tall side 21. The outside vertical edge 23 is interrupted by a rectangular tab 26 spaced above the bottom edge 19. A short side 28 of the plate 18 has a stepped upper profile; three edge segments, 31, 32 and 33 are separated by short vertical tabs 34. Two outer edge segments 32, 33 lie on a common line while the third segment 31 lies slightly below the outward segments. Upper edges 36 of the tabs 34 lie on a common horizontal line. An outside vertical edge 35 of the short side 28 is interrupted by a rectangular tab 40 spaced above the bottom edge 19.

Each of the tall and short sides or sections 21, 28 is stamped with a pair of holes 37 for receiving a self-drilling screw, pop rivet or like fastener. A relatively large hole 38 is stamped in the inner end of the short section or side 28 and a small oval hole 39 is stamped in an outer end of the short section.

The overall length of the splice plate 18, measured across the vertical edges of the tabs 26, 40, is preferably the same as the center-to-center distance of the cross tee slots 16 stamped in the webs of the main tees. In the United States, this center-to-center distance is typically 6 inches. By way of example, the vertically short main tees 12 are manufactured with lengths of 10 feet and 12 feet while the tall main tees 13 are manufactured at lengths of 8 foot 6 inches, 10 foot 6 inches and 12 foot 6 inches.

Figure 3:
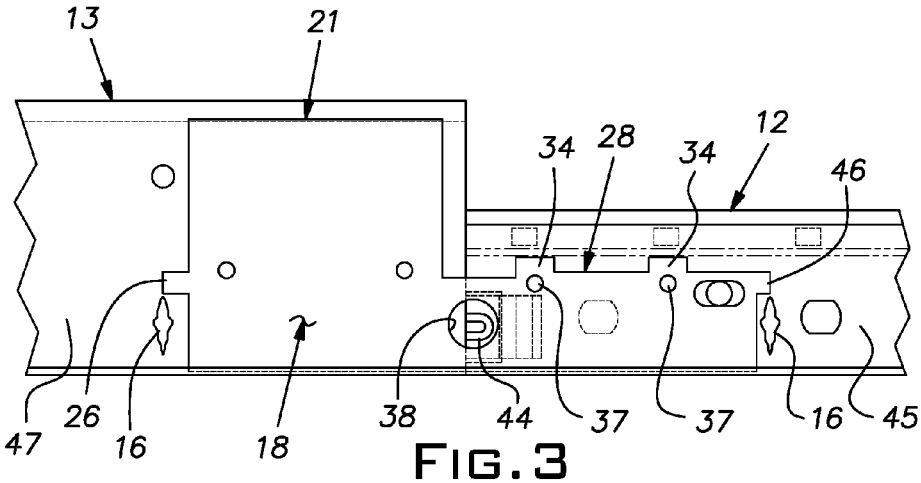
FIG. 3 is an enlarged view of a joint between ends of main tees of different heights employing the splice plate where an original integral end connector on a vertically short tee has been modified to obtain a butt joint.
Figure 4:
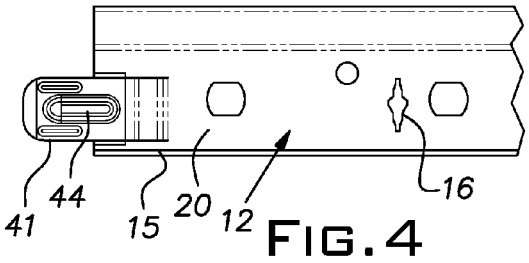
FIG. 4 is a fragmentary view of an end of a vertically short main tee having a conventional integral end connector.

FIG. 3 shows a condition, illustrated with less detail towards the right in FIG. 1, where the factory end of a vertically short main tee 12 is abutted with the end of a tall main tee 13. FIG. 4 shows the factory end of the vertically short main tee 12 before it is field modified for making a joint with the tall main tee 13. A tin snips or other tool is used to sever the projecting part of an original end connector 41 at the transverse plane of an end of the tee flange 15 and web 20. The end connector 41 can be of the type illustrated in U.S. Pat. No. 6,729,100 and, as such, will have a bulbous part 44 (projecting above the plane of the drawing of FIG. 4.)

With the vertically short main tee 12 modified at its end, the splice plate 18 can be properly longitudinally located on the tee by aligning the vertical edge, designated 46 of the end tab 40 serving as an indicia with the center of the adjacent cross tee slot 16 at the tee end. The splice plate 18 is fixed to the tee 12 with fasteners through the holes 37 and web 45. The configuration and location of the tab 40, being spaced above and from the cross tee slot 16 assures that it cannot interfere with reception of a cross-tee connector in the slot and abutment of the connector against the web 45.

The remainder of the bulbous formation of the end connector 41 is received with clearance in the hole 38.

Typically a factory edge of the tall tee is spaced one-half the center-to-center distance of the cross tee slots 16. Therefore, the vertical edge serving as an indicia of the associated tab 26 will be aligned with the slot 16 on the tall tee 13 and the splice plate 18 can be attached with fasteners in the holes 37 and the tall tee web, designated 47. Alternatively, the splice plate 18 can be first attached to the tall tee 13, using the tab/alignment technique and then be attached to the vertically shorter tee 12.

Figure 2:
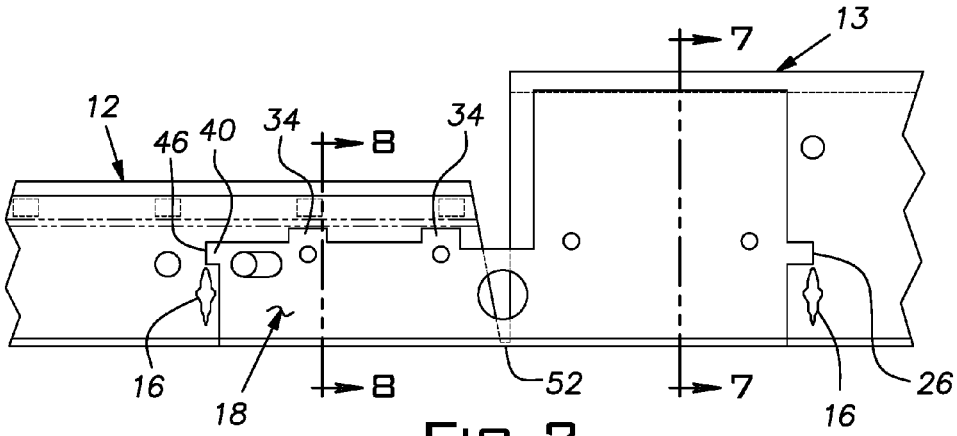
FIG. 2 is an enlarged view of a joint between ends of the main tees of different heights employing the splice plate of the invention where a vertically shorter one of the tees has been field cut to a desired length.
Figure 6:
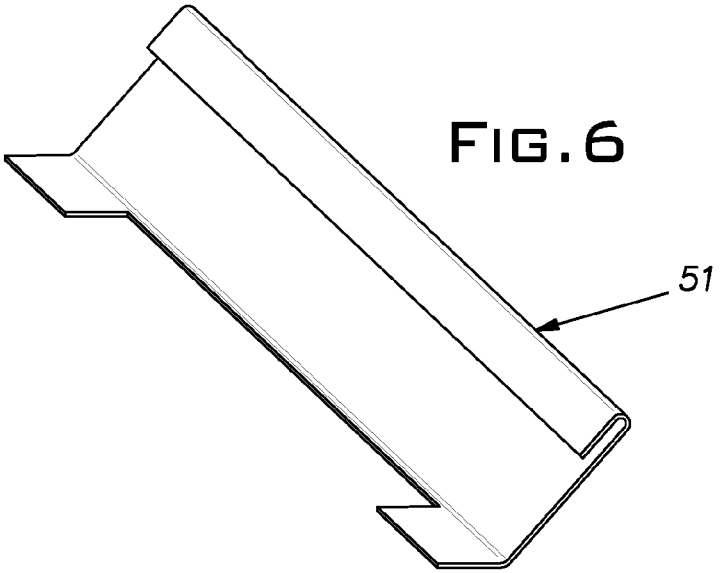
FIG. 6 is a perspective view of a sheet metal tee face sleeve used to conceal a gap or other imperfection at a pair of end joined tees.

FIG. 2 illustrates an end joint between a tall main tee 13 and a vertically short main tee 12. The joint in FIG. 2 corresponds to the leftward end of the tall main tee 13 illustrated in FIG. 1. The vertically short tee 12 is field trimmed so that its end is not more than one-half the cross tee slot center-to-center distance and, preferably, is slightly less. The splice plate 18 is installed as described above with the vertical edges of the tabs centered over respective ones of the cross tee slots in the short main tee 12 and the tall main tee 13. A tee face sleeve 51, illustrated in FIG. 6, can be applied on the lower faces of the flanges of the joined ends to conceal any gap 52 (FIG. 2) or mis-alignment due to field cutting of the main tee 12.

In the situations of FIGS. 2 and 3, it will be seen that the splice plate 18 fits closely in the vertical space between the tops of the flanges 15, 17 and the hollow reinforcing bulbs 29, 30. Preferably, the upper and lower edges of the plate 18 directly contact the top of the respective flanges 15, 17 and bottoms of the respective reinforcing bulbs 29, 30 so that there is no clearance and the tees are in vertical registration at the bottom faces of the flanges. With the splice plate abutted against the respective webs of the joined tees, the tees are held in horizontal registration.

Where a short main tee of less height than the tee 12 illustrated in the figures is being used, the tabs 34 of the splice plate 18 are field cut-off flush with the edge sections 32, 33. This can be done with a tin snips or other suitable tool. The height of the edge sections 32, 33 above the lower edge 19 is arranged for a fit without clearance between the top of the flange and the bottom of the reinforcing bulb of the shorter main tee. The modified splice plate is assembled on the ends of the vertically short tee and the tall tee in a manner described above.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A suspended ceiling grid structure comprising first and second grid tees joined at respective ends by a splice plate, the grid tees each having an upper hollow reinforcing bulb, a lower horizontal flange, and a vertical web joining the bulb with the flange, the bulb and flange being generally symmetrically disposed about a vertical plane in which the web lies, the web of the first tee having a first height, the web of the second tee having a second height greater than the first height and contributing to a beam strength of the second tee that is greater than a beam strength of the first tee whereby the second tee is capable of carrying a ceiling weight loading across an unsupported span greater in length than an unsupported span length that the first tee under the same loading is capable of carrying, the splice plate being flat with a first section in contact with a bottom of the reinforcing bulb at the web and the flange at the web of the first tee, and a second section in contact with a bottom of the reinforcing bulb at the web and the flange at the web of the second tee, the splice plate serving to vertically and horizontally align the first tee to the second tee, the flat splice plate abutting the webs of the first and second tees across full height areas between the reinforcing bulb and flange of the first tee and the reinforcing bulb and flange of the second tee, the first section adjacent a mid-length of the splice plate including an aperture for receiving a bulbous formation of an end connector on the first tee.

2. A suspended ceiling grid structure set forth in claim 1, wherein the splice plate has a pair of holes through which are driven screws for fixing the first section to the first tee and a pair of holes through which are driven screws for attaching the second section to the second tee.

3. A suspended ceiling grid structure comprising first and second grid tees joined at respective ends by a splice plate, the grid tees each having an upper hollow reinforcing bulb, a lower horizontal flange, and a vertical web joining the bulb with the flange, the bulb and flange being generally symmetrically disposed about a vertical plane in which the web lies, the web of the first tee having a first height, the web of the second tee having a second height greater than the first height and contributing to a beam strength of the second tee that is greater than a beam strength of the first tee whereby the second tee is capable of carrying a ceiling weight loading across an unsupported span greater in length than an unsupported span length that the first tee under the same loading is capable of carrying, the splice plate having a first section in contact with the reinforcing bulb, web and flange of the first tee, and a second section in contact with the reinforcing bulb, web and flange of the second tee, the splice plate serving to vertically and horizontally align the first tee to the second tee, said plate having a lower edge lying on a horizontal straight line, a section of said plate usable with the short tee having a pair of tabs each having the same distance above the line of the lower edge.

4. A splice plate for joining the ends of suspended ceiling main tees of different heights and load carrying capacity, the plate having a bottom edge lying along a straight line and having a tall section adjacent one end and a short section adjacent an end opposite said one end, a formation at each of said ends providing indicia for locating the formation on the respective section on an end of a main tee of a corresponding height longitudinally at a desired position relative to and spaced from a cross runner slot on the main tee of corresponding height, the short section including elements extending vertically above adjacent areas and establishing an original height of said short section, said elements being severable from said short section to establish an optional height of said short section that is less than said original height.

5. A splice plate as set forth in claim 4, wherein the indicia providing formation at one end is spaced vertically above the bottom edge the same distance as the formation at the opposite end.

6. A splice plate as set forth in claim 4, wherein each section has a pair of holes for receiving fasteners for attaching the section to a web of respective main tee.

7. A splice plate as set forth in claim 4, wherein the short section adjacent a mid-length of the splice plate includes an aperture for receiving a bulbous formation of an end connector on a vertically short one of a joined pair of main tees.

* * * * *